United States Patent [19]

Teetz et al.

[11] 4,366,763

[45] Jan. 4, 1983

[54] AUTOMATIC EMBROIDERY MACHINE HAVING A PLURALITY OF SINGLE-NEEDLE EMBROIDERY HEADS

[75] Inventors: Wolfgang Teetz, Kerken; Hans-Gerd Ripkens, Goch, both of Fed. Rep. of Germany

[73] Assignee: Maschinenfabrik Carl Zangs Aktiengesellschaft, Krefeld, Fed. Rep. of Germany

[21] Appl. No.: 189,543

[22] Filed: Sep. 22, 1980

[30] Foreign Application Priority Data

Sep. 25, 1979 [DE] Fed. Rep. of Germany ... 7927132[U]

[51] Int. Cl.[3] ..... D05C 7/04

[52] U.S. Cl. ..... 112/98; 112/155

[58] Field of Search ..... 112/98, 89, 78, 99, 112/100, 101, 155, 85

[56] References Cited

U.S. PATENT DOCUMENTS 1,057,558 4/1913 Keller ..... 112/89

3,595,188 7/1971 Schmedding et al. ..... 112/155 X

FOREIGN PATENT DOCUMENTS 1410563 3/1969 Fed. Rep. of Germany ..... 112/85

*Primary Examiner*—Peter P. Nerbun

*Attorney, Agent, or Firm*—Martin A. Farber

[57] ABSTRACT

The present invention relates to an automatic embroidery machine having a plurality of single-needle embroidery heads which are driven by a common main drive shaft. In order to also be able to produce drill patterns with such an automatic embroidery machine, a drill rod provided with a drill is arranged in each embroidery head, the rod being supported for movement parallel to the embroidery needle and being adapted to be driven from the main drive shaft by a transmission which makes it possible to stop the drill rod in the disengaged position. This transmission comprises a ring eccentric arranged on the main drive shaft and two carriages which are supported for displacement in a linear guide and can be coupled with each other, the drive carriage being connected via a connecting rod with the ring eccentric and the driven carriage being connected by a push rod with a central drive lever which actuates a continuous drive shaft for all drill rods.

9 Claims, 3 Drawing Figures

AUTOMATIC EMBROIDERY MACHINE HAVING A PLURALITY OF SINGLE-NEEDLE EMBROIDERY HEADS

The present invention relates to an automatic embroidery machine having a plurality of single-needle embroidery heads which are driven by a common main drive shaft.

Multi-head automatic embroidery machines, which are also known as small automatic knitting machines, are known in various embodiments. In the single-needle embodiment they are suitable solely for the production of normal embroidery patterns. In the case of multi-needle embroidery heads, one needle can be replaced by a drill so that there is the possibility, by slitting the fabric to be embroidered, of drilling holes in the material being embroidered, embroidering being effected around them after the drilling so that so-called drill patterns can be produced in addition to the normal embroidery patterns.

The object of the present invention is to develop small automatic embroidery machines having single-needle embroidery heads in such a manner that, if necessary, drill patterns can also be produced, without a separate drilling device having to be used for this.

This purpose is achieved by the invention in the manner that in each embroidery head there is arranged a drill rod provided with a drill, which rod is supported for movement parallel to the embroidery needle and can be driven by a transmission which makes it possible to stop the drill rod in its disengaged position.

By this development in accordance with the invention it is possible, even on automatic embroidery machines having a plurality of single-needle embroidery heads, to produce, by means of the drilling device developed in each embroidery head, within the fabric to be embroidered holes around which embroidery is effected by means of the embroidery needle after the drilling. In this way, the possibilities for the development of the embroidery patterns are considerably expanded.

In accordance with another feature of the invention, the transmission comprises a ring eccentric and two carriages which are supported for displacement in a linear guide and can be coupled to each other, the driving carriage being connected via a connecting rod with the ring eccentric and the driven carriage being connected via a push rod with a drive lever which actuates a continuous drive shaft for all drill rods. This further development in accordance with the invention represents a very simple and dependable construction for the disconnectable drive of the drill rods and, due to the use of the existing main drive shaft for the driving of the drill rods, does not require either separate drives or expensive constructions, particularly since the transmission is arranged only centrally and the individual drill rods are driven by a continuous drive shaft.

In one suitable further development of the invention, the central drive lever is developed as an angle-arm lever which is mounted non-rotatably on the drive shaft, one lever arm of which is pivoted to the push rod.

In order to make it possible to change the drilling depth simultaneously for all drills, the second lever arm of the central drive lever which is developed as an angle-arm lever is provided with a plurality of pivot holes to receive the pivot pin of the push rod, so that a change in the depth of drilling can be effected by a change in the length of the lever arm.

One particularly simple and reliable development of the coupling between the two carriages is obtained, in accordance with the invention, in the manner that the coupling of the two carriages is effected by a pawl which is swingably supported on one of the carriages and is spring-loaded, the pawl being provided with a detent projection which engages behind a part of the corresponding other carriage and with a control arm which can be actuated by a control member. This control member can be brought against the force of a spring, by the ram of a magnet, from a blocking position into a non-engagement position, it being possible readily to control the magnet from the control device of the automatic embroidery machine.

By the invention it is also proposed to develop the control member in angular shape and to mount it swingably so that in the blocking position one angle arm cooperates with the control arm of the pawl. The angle arm which is in the blocking position sees to it in this way that the pawl is always held in its disengaged position via its control arm so that the device carriage, which is moved continuously back and forth with the ring eccentric, is not connected with the driven carriage as long as the magnet does not receive a control command which places the control member into the active position.

As a whole, by the proposal of the invention there is obtained a small automatic embroidery machine which, by means of a simple and functionally reliable construction and in a simple manner can be used for the slitting of the fabric to be embroidered so that, despite the single-needle development of the embroidery heads, drill patterns can be produced on the automatic embroidery machine.

With the above and other objects and advantages in view, the present invention will become more clearly understood in connection with the detailed description of preferred embodiments, when considered with the accompanying drawings, of which:

Figure 1:
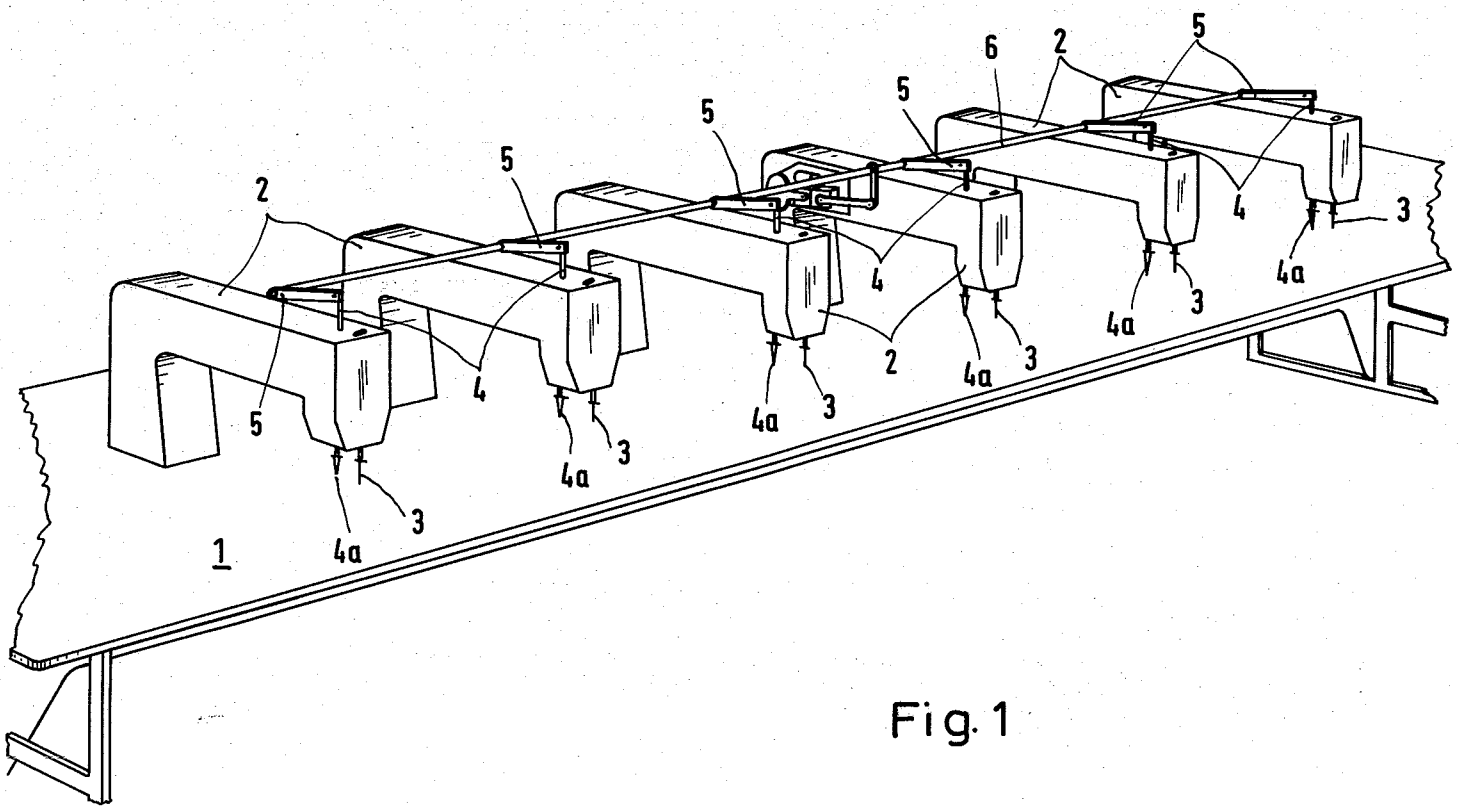
FIG. 1 is a partial perspective view of an automatic embroidery machine.

The perspective showing of FIG. 1 shows the table 1 of an automatic embroidery machine which is equipped with a plurality of embroidery heads 2, each of which has an embroidery needle 3. Parallel to this embroidery needle 3 a drill rod 4, provided with a drill 4*a*, is arranged in each embroidery head 2. Each drill rod 2 can be driven back and forth by a lever 5 which is fastened fixed rotatably therewith on a continuous drive shaft 6.

Figure 2:
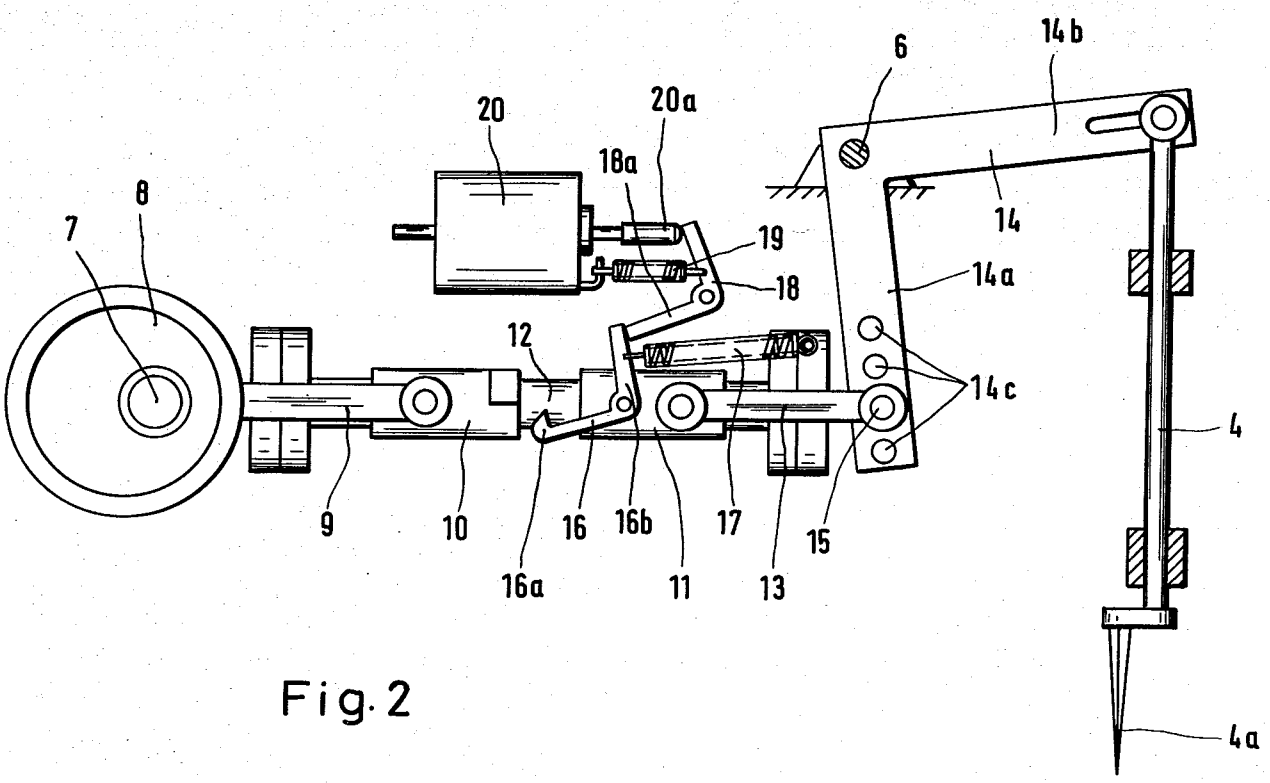
FIG. 2 is a side view of the transmission used for the drive of the drill rods, shown in disengaged position.
Figure 3:
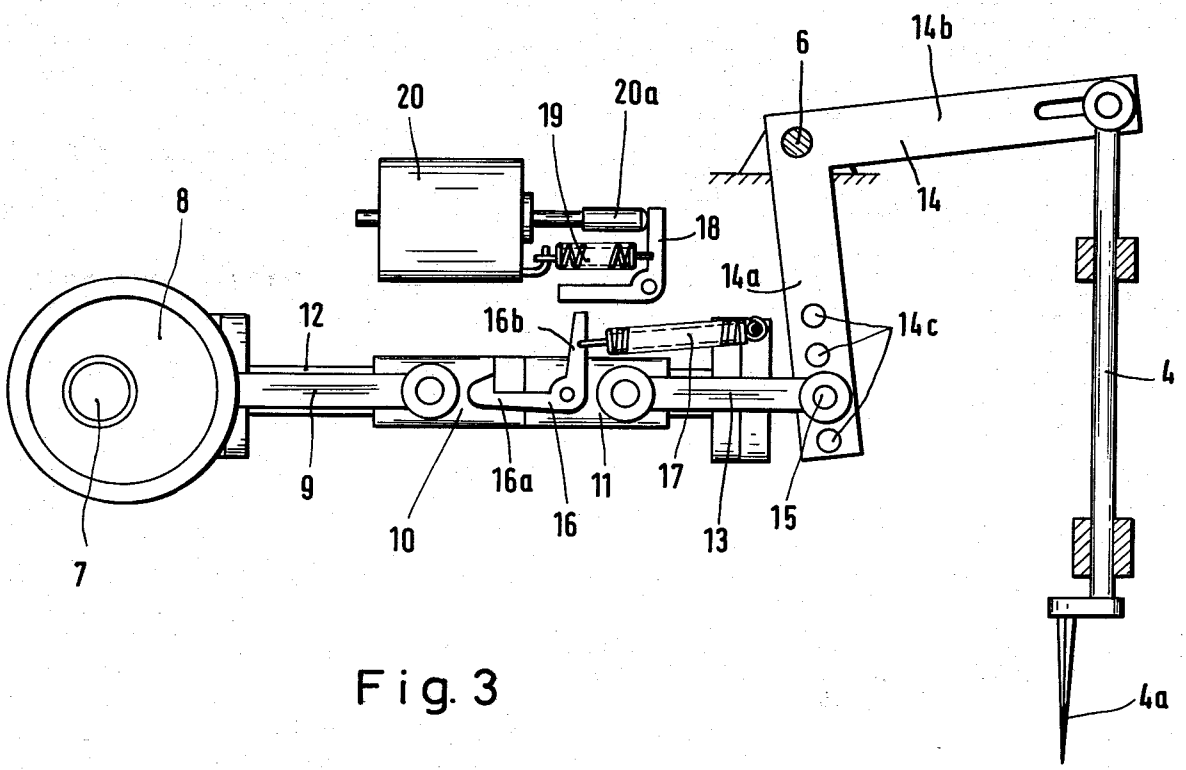
FIG. 3 is a side view corresponding to FIG. 2 with drill rods in engaged position.

The oscillating drive of this drive shaft 6 is effected from the main drive shaft of the automatic embroidery machine by a transmission, the central position of which is indicated in FIG. 1 and the details of which are shown in FIGS. 2 and 3.

The transmission comprises a ring eccentric 8 arranged on the main drive shaft 7 and articulated by a connecting rod 9 to one of two carriages 10 and 11. Both of the carriages 10 and 11 are displaceably mounted in a linear guide 12 and can be coupled with each other. In this way the drive carriage 10 can be connected with the driven carriage 11, which is articulated by a push rod 13 to a central drive lever 14. This central drive lever 14, which is developed as an two-armed angle lever in FIGS. 2 and 3 (but as a single-arm lever in FIG. 1 in modification), is fastened non-rotatably onto the continuous drive shaft 6 so that a reciprocating motion of the interconnected carriages 10 and 11 results in an oscillating pivot movement of the drive shaft 6.

The coupling of the two carriages 10 and 11 is effected, in the embodiment shown in the drawing, by a pawl 16 which is swingably supported on the driven carriage 11. This pawl is provided with a detent projection 16*a* which cooperates with a correspondingly formed part of the drive carriage 10. The pawl furthermore has a control arm 16*b* on which a pawl spring 17 acts.

Via this control arm 16*b*, the detent projection 16*a* of the pawl 6 can be brought out of engagement with the drive carriage 10 by swinging it in counterclockwise direction against the force of the pawl spring 17 by means of a control member 18. This control member 18 is also of angular development in the embodiment shown in the drawing and is acted on by a spring 19. The actuation of the control member 18 is effected by the ram 20*a* of a magnet 20.

In the engaged position shown in FIG. 3, the ram 20*a* of the magnet 20 pushes the control member 18, in opposition to the force of the spring 19, into a position in which the angle arm 18*a* of the control member 18, which arm cooperates with the control arm 16*b* of the pawl 16, goes out of engagement with the control arm 16*b*. In this way, the pawl spring 17 which acts on the control arm 16*b* pulls the pawl 16 into a position in which the detent projection 16*a* of the pawl 16 engages behind the corresponding part of the drive carriage 10. The reciprocating movement imparted to the drive carriage 10 by the ring eccentric 8 via the connecting rod 9 is in this way transmitted to the driven carriage 11. The latter transmits it, via the push rod 13, to the central drive lever 14. Since this central drive lever 14 is fastened on non-rotatably relative to the continuous drive shaft 6, the reciprocating movement of the carriages 10 and 11 produces an oscillating turning movement of the drive shaft 6, which, via the likewise connected levers 5, results in a reciprocating movement in the vertical direction of the drill rods 4.

In order to obtain the necessary equalization of play in these different movements, each of the levers 5 is connected by a slot connection with the corresponding drill rod 4. The upper lever arm 14*b* of the central, double-armed angular drive lever 14 of the modification of FIGS. 2 and 3 is connected by such a slot connection to the associated drill rod 4 of of the embroidery head 2 to which the central transmission is coordinated serving the same function as the lever 5 of the associated embroidery head of FIG. 1. The lower lever arm 14*a* is provided with a plurality of pivot holes 14*c* each adapted to receive a pivot pin 15 arranged on the end of the push rod 13. By a suitable selection of the pivot holes 14*c* the lever length of the lower lever arm 14*b* of the central drive lever 14 can be changed, as a result of which the stroke of the drills 4*a* of all drill rods 4 is simultaneously changed.

In order to disengage the drills 4*a* it is merely necessary to actuate the magnet 20. The ram 20*a*, in the position thereof shown in FIG. 2, releases the control member 18 so that the spring 19 acting on the latter can swing the angle arm 18*a* into the blocking position shown in FIG. 2. In this position, the control arm 16*b* of the pawl 16 comes against the angle arm 18*a* of the control member 18 which extends into the path of movement of the control arm 16*b*. In this way the pawl 16 is swung againt the force of the pawl spring 17. This swinging results in a release of the drive carriage 10 by the detent projection 16*a* of the pawl 16 so that thereupon only the drive carriage 10 can still be moved back and forth by the ring eccentric 8, without the driven carriage 11 being carried along in this movement. Instead, the drive carriage 11 is held by the pawl spring 17 in its rear end position in which the central drive lever 14, via the continuous drive shaft 6, holds all drill rods 4 fast in the upper position, withdrawn from the material.

In order to again actuate the drills 4*a* it is necessary, at the desired time, again merely to actuate the magnet 20 in order to bring the parts of the transmission from the position shown in FIG. 2 into the position shown in FIG. 3 in which the two carriages 10 and 11 are coupled with each other.

We claim:

1. An automatic embroidery machine having a plurality of embroidery heads having a single embroidery needle in each head driven by a common main drive shaft, comprising a drill rod mounted in each embroidery head displaceably parallel to the embroidery needles, said drill rod having a drill thereon, a transmission means for driving said drill rods from the main drive shaft, said transmission means for stopping said drill rods in a disengaged position thereof, said transmission means comprises, a ring eccentric arranged on the main drive shaft, a linear guide, two carriages are displaceably mounted in said linear guide and couplably with each other, one of said carriages is a drive carriage, a connecting rod connects said ring eccentric to said drive carriage, the other of said carriages is a driven carriage, a continuous drive shaft is operatively connected to all said drill rods, a central drive lever means for actuating said continuous drive shaft, and a push rod is connected to said driven carriage and said central drive lever means.

2. The automatic embroidery machine according to claim 1, wherein said central drive lever means is formed as an angle-arm lever which is mounted relatively non-rotatably on said continuous drive shaft, said central drive lever means has one lever arm articulated to said push rod.

3. The automatic embroidery machine according to claim 2, wherein said one lever arm of said central drive lever means is formed with a plurality of pivot holes, said push rod has a pivot pin selectably engageable in said pivot holes.

4. The automatic embroidery machine according to claim 1, wherein said transmission means includes, a continuous drive shaft, a plurality of levers, corresponding in number to the number of embroidery heads, are fastened non-rotatably to said continuous drive shaft, each of said plurality of levers is formed with a slot connection to a corresponding of said drill rods, respectively.

5. The automatic embroidery machine according to claim 1, further comprising a spring-biased pawl means for coupling of said two carriages, said spring-biased pawl means is swingably mounted on one of the carriages and has a detent projection which is engageable behind a part of a respective other one of said carriages, said pawl means is formed with a control arm, a control member means for actuating said control arm so as to release said pawl means.

6. The automatic embroidery machine according to claim 5, further comprising a spring means for biasing said control member means, a magnet having a moveable ram means for bringing said control member means in opposition to said spring means from a blocking position thereof into a non-engagement position thereof.

7. The automatic embroidery machine according to claim 6, wherein said control member means is of angular formation having angle arms and is pivotally mounted such that in the blocking position one of said angle arms cooperates with said control arm of said pawl means.

8. The automatic embroidery machine according to claim 1, wherein said transmission means is centrally disposed with respect to said plurality of embroidery heads.

9. The automatic embroidery machine according to claim 6 or 7, wherein said control member means when actuating said control arm effects said blocking position, the latter being a position in which said control members means blocks said control arm of said pawl means, and said non-engagement position being a position in which said control member means is not engaged with said control arm of said pawl.

* * * * *